US006419009B1

(12) United States Patent
Gregory

(10) Patent No.: US 6,419,009 B1
(45) Date of Patent: Jul. 16, 2002

(54) RADIAL FLOW HEAT EXCHANGER

(76) Inventor: Christian Thomas Gregory, 3602 Third Ave., La Crescenta, CA (US) 91214-2436

( * ) Notice: Subject to any disclaimer, the term of this patent is extended or adjusted under 35 U.S.C. 154(b) by 0 days.

(21) Appl. No.: 09/131,930

(22) Filed: Aug. 10, 1998

Related U.S. Application Data

(60) Provisional application No. 60/055,303, filed on Aug. 11, 1997.

(51) Int. Cl.[7] ..... F28D 1/053

(52) U.S. Cl. ..... 165/151; 165/144; 165/146; 165/153

(58) Field of Search ..... 165/151, 154, 165/155, 146, 147, 148, 175, 144, 145, 173, 153

(56) References Cited

U.S. PATENT DOCUMENTS

| | | | | | |
|---|---|---|---|---|---|
| 1,226,379 | A | * | 5/1917 | Riley, 2D. | 165/145 X |
| 1,428,718 | A | * | 9/1922 | Sturtevant | 165/72 |
| 1,524,520 | A | * | 1/1925 | Junkers | 165/146 |
| 1,897,413 | A | * | 2/1933 | Anderson | 165/175 |
| 1,965,011 | A | * | 7/1934 | Swan | 165/155 X |
| 2,055,549 | A | * | 9/1936 | Modine | 165/146 |
| 2,479,071 | A | * | 8/1949 | Henstridge | 165/155 X |
| 2,508,729 | A | * | 5/1950 | Stein | 165/151 X |
| 2,965,360 | A | * | 12/1960 | Brown, Jr. | 165/144 |
| 3,064,947 | A | * | 11/1962 | McNab | 165/149 |
| 3,520,356 | A | * | 7/1970 | Bell et al. | 165/145 X |
| 3,889,744 | A | * | 6/1975 | Hill et al. | 165/165 X |
| 5,284,203 | A | * | 2/1994 | Dauvergne | 165/174 |
| 5,307,867 | A | * | 5/1994 | Yasuda et al. | 165/109.1 |
| 5,660,230 | A | * | 8/1997 | Obosu et al. | 165/151 |
| 5,797,449 | A | * | 8/1998 | Oswald et al. | 165/165 |
| 5,816,322 | A | * | 10/1998 | Albano et al. | 165/154 X |
| 5,832,994 | A | * | 11/1998 | Nomura | 165/144 X |

FOREIGN PATENT DOCUMENTS

| | | | | |
|---|---|---|---|---|
| GB | 713062 | * | 8/1954 | 165/145 |
| SU | 276092 | * | 9/1970 | 165/174 |

* cited by examiner

*Primary Examiner*—Leonard Leo
(74) *Attorney, Agent, or Firm*—Christie, Parker & Hale, LLP

(57) ABSTRACT

A radial flow heat exchanger for heating or cooling a fluid includes a sealed fluid manifold for passage of fluid. A sealed fluid receiving hub is spaced interiorly of the interior peripheral portion of the manifold and includes a passageway for passage of fluid into or out of the heat exchanger. A plurality of separate and spaced fluid flow tubes are disposed between the manifold and the hub. Each of the tubes are in sealed fluid communication with the manifold at one end and the other end is in sealed fluid communication with the hub. A fin assembly is positioned between the manifold and the hub and includes a heat conducting material arranged at spaced intervals between the manifold and the hub, the heat conducting material including a plurality of spaced apertures through which tubes pass. The heat conducting material is in intimate heat conducting contact with the tubes whereby fluid flowing between the manifold and the hub flows into each of the tubes in a radial direction between the manifold and the hub and wherein the heat conducting material of the fin assembly operates to give up or pick up heat from the fluid through the wall of the tubes.

15 Claims, 14 Drawing Sheets

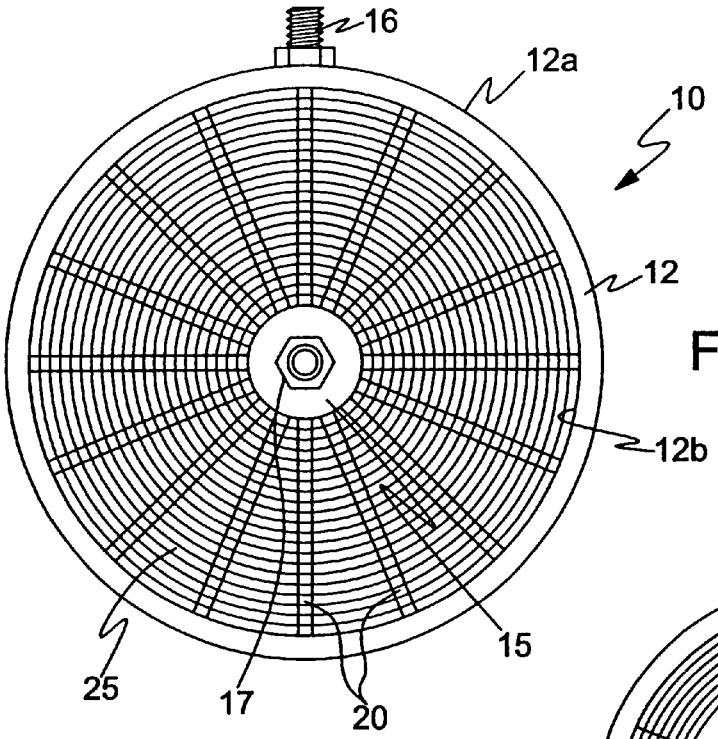
FIG. 1
FIG. 1A
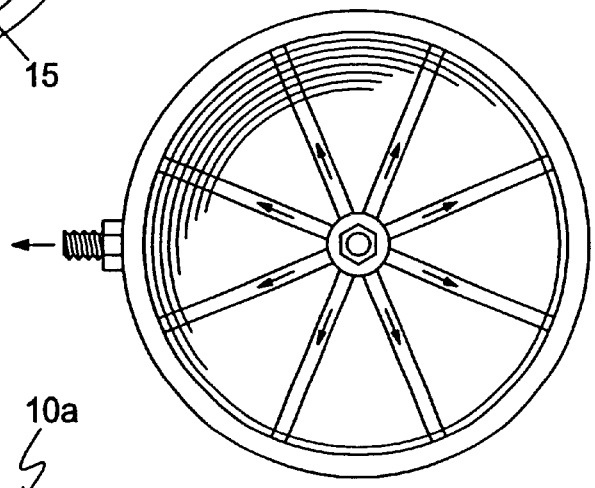
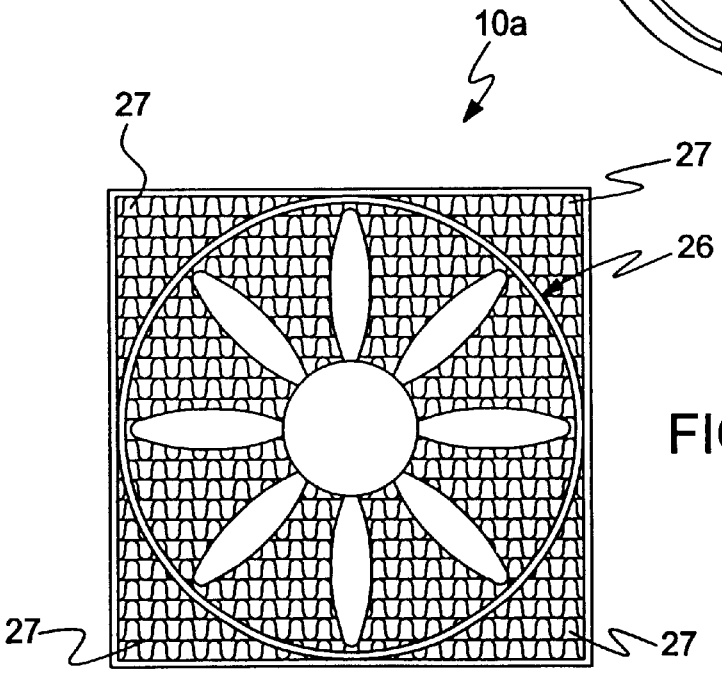
FIG. 2

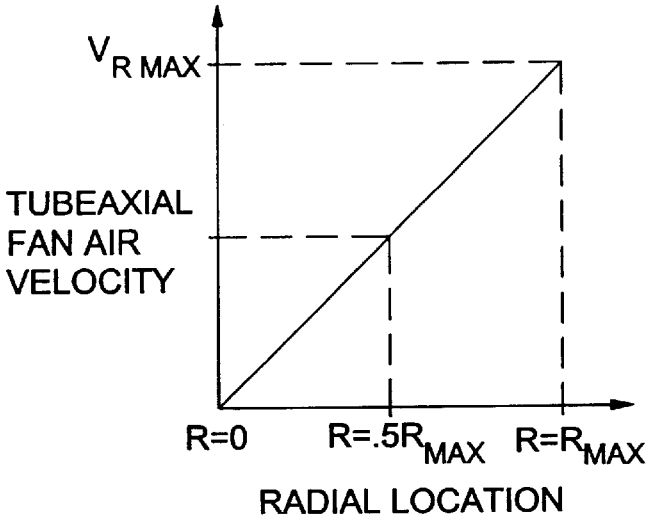
FIG. 3
FIG. 4
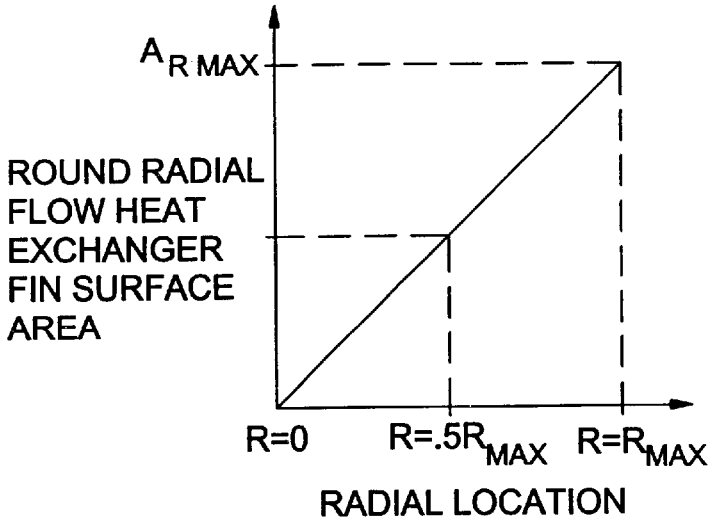
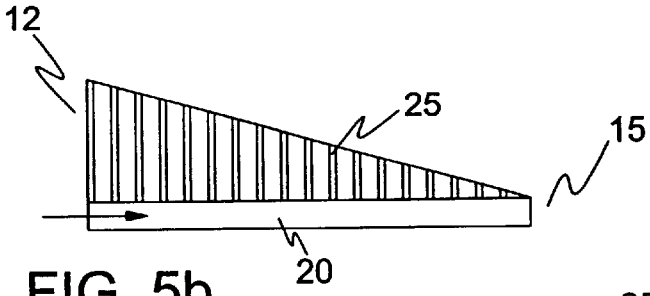
FIG. 5b
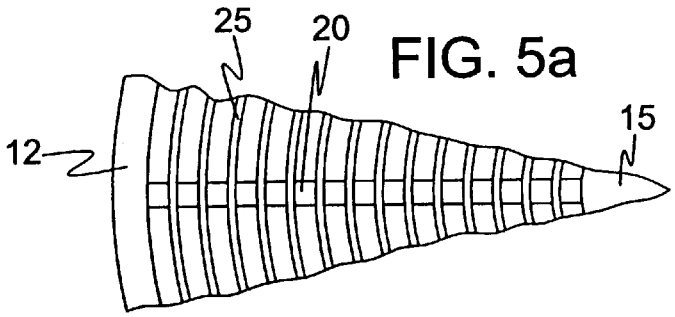
FIG. 5a

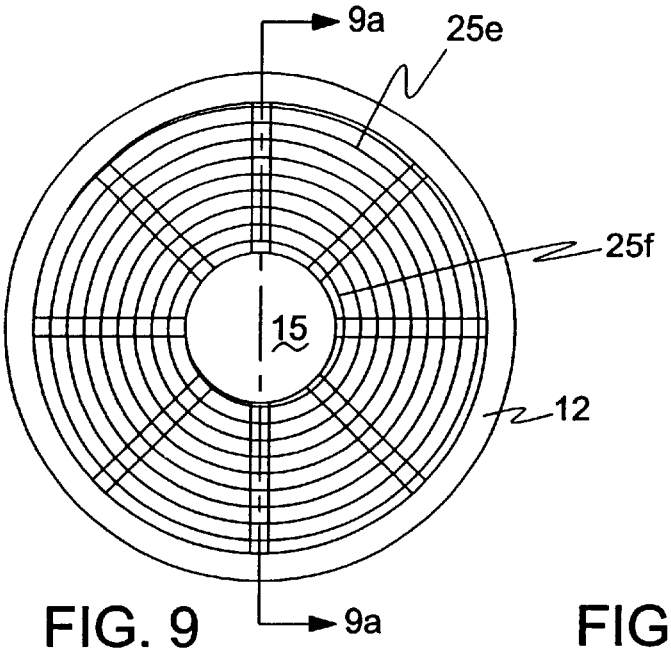
FIG. 9
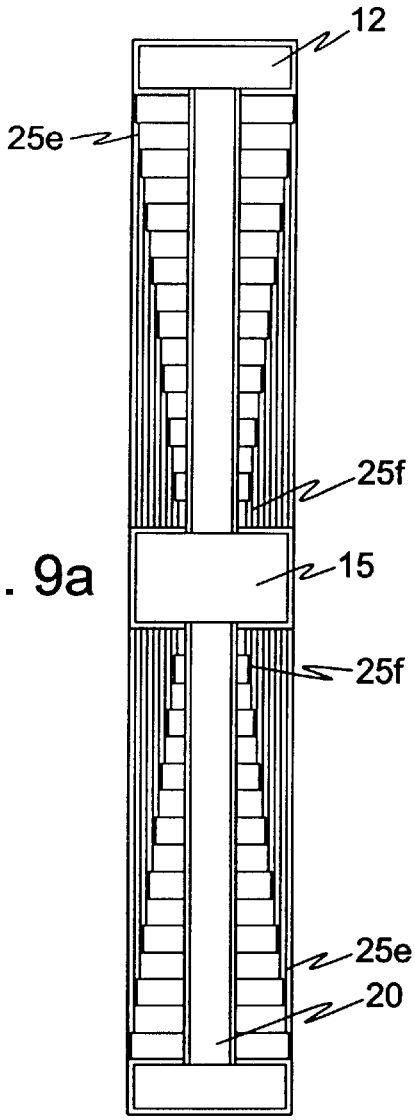
FIG. 9a
FIG. 10
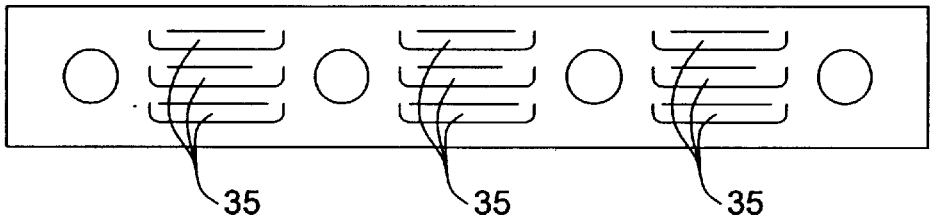
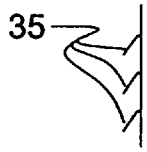
FIG. 10a

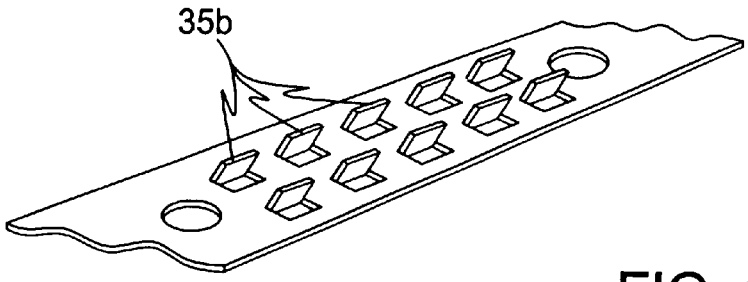
FIG. 11
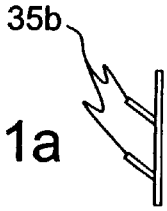
FIG. 11a
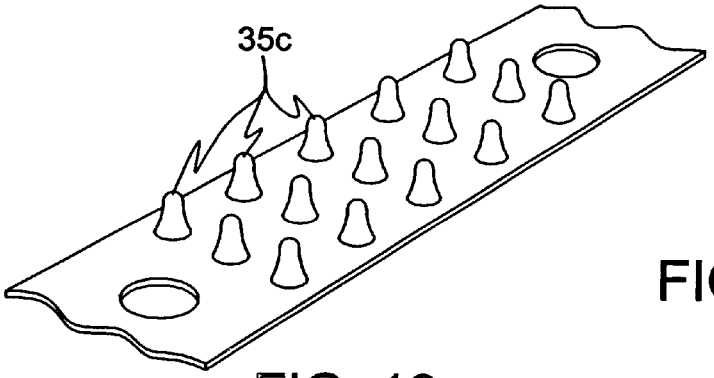
FIG. 12
FIG. 12a
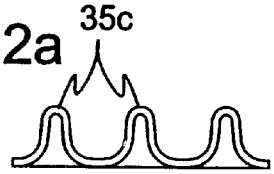
FIG. 13
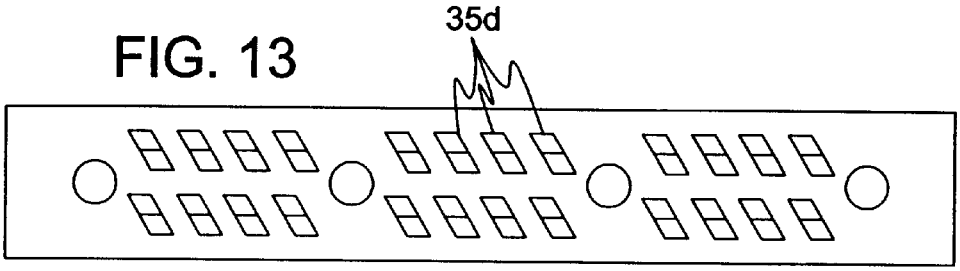
FIG. 13a
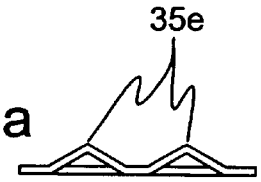

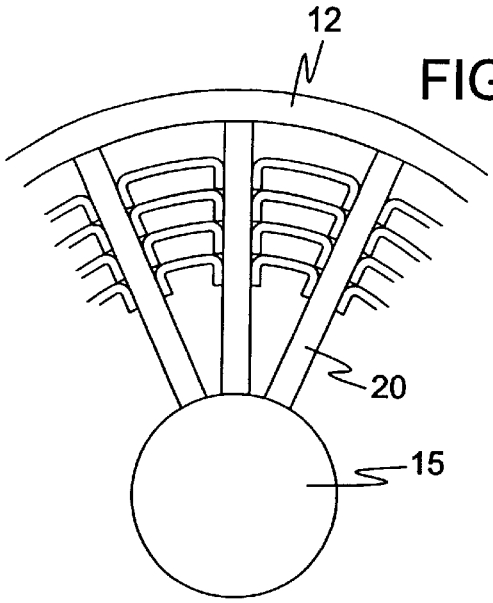
FIG. 14c
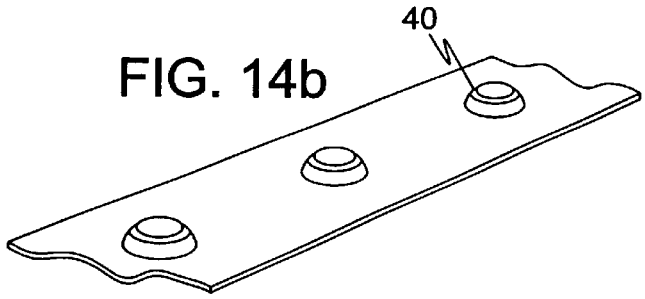
FIG. 14b
FIG. 14a
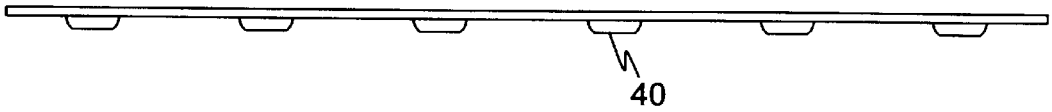
FIG. 15a
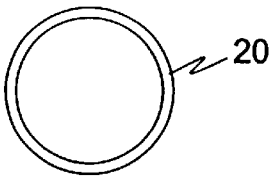
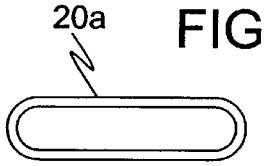
FIG. 15b

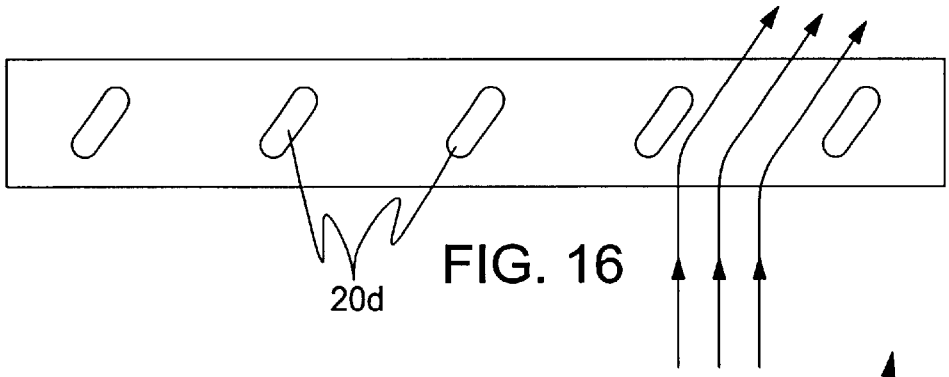
FIG. 16
FIG. 17a
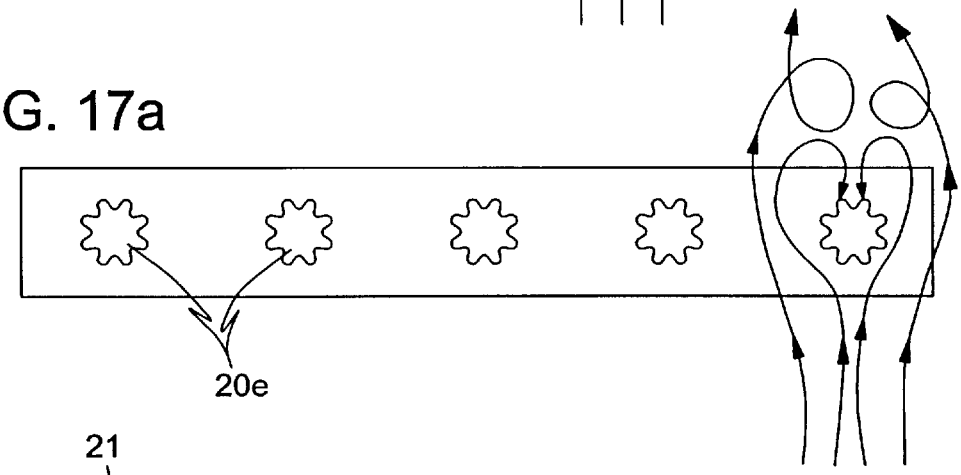
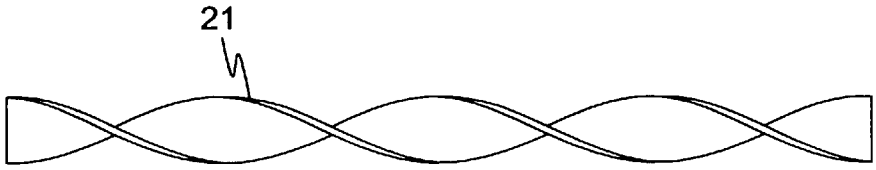
FIG. 17b
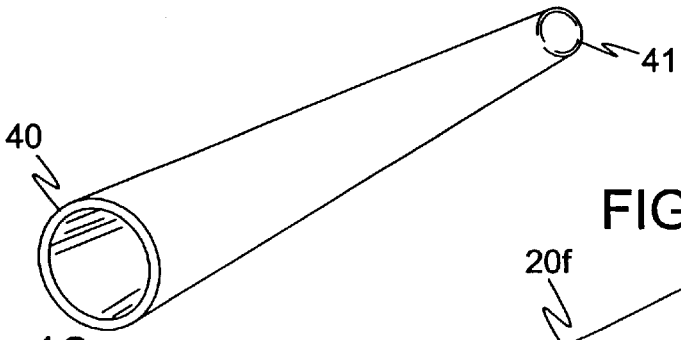
FIG. 18
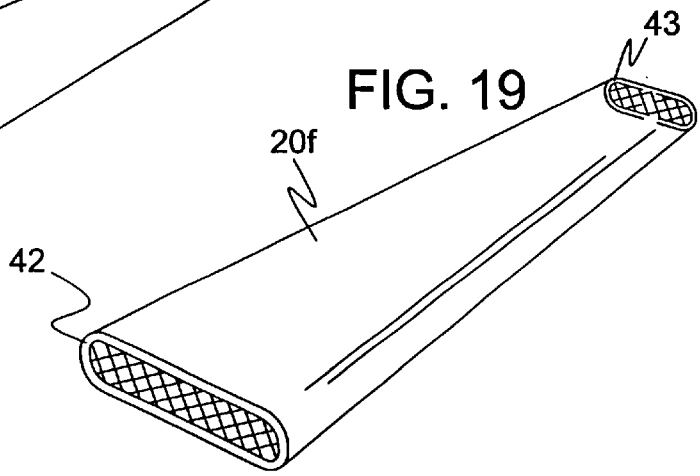
FIG. 19

RADIAL FLOW HEAT EXCHANGER

RELATED APPLICATIONS

This application is a conversion of Provisional Application Ser. No. 60/055,303, filed on Aug. 11, 1997.

FIELD OF INVENTION

This invention relates to heat exchangers and more particularly to an improved radial flow heat exchanger in which the fluid to be heated or cooled flows between an outer peripheral portion of the heat exchanger, through a plurality of radially extending tubes, and a center hub, the tubes passing through a fin arrangement.

BACKGROUND OF THE INVENTION

Various types of heat exchangers are known such as shell in tube heat exchangers and radial flow heat exchangers. In the radial flow heat exchangers of the prior art, fluid flow tubes are arranged in a helical manner with the flow of fluid being in a spiral fashion through the helically formed tubes. Typical of the prior art patents related to radial flow heat exchangers are the following: Kissinger, U.S. Pat. No. 4,182,413 of 1980; Gilli et al, U.S. Pat. No. 3,712,370 of 1973; Tipman et al, U.S. Pat. No. 5,088,550 of 1992; Borjesson et al. U.S. Pat. No. 4,128,125 of 1978; Dobbins et al, U.S. Pat. No. 4,883,117 of 1989, by way of example.

In addition to the above, there are numerous patents dealing with heat exchangers such as those with radial baffles, U.S. Pat. No. 4,642,149; spiral heat exchangers, U.S. Pat. No. 4,993,487; circumferential flow heat exchangers, U.S. Pat. No. 5,343,936; finned tube heat exchangers, U.S. Pat. No. 5,355,944, as an example.

While most of the prior art heat exchangers generally operate satisfactorily for their intended purpose, in some cases, the heat exchanger is of a complex shape, relatively expensive to manufacture, sometimes have a relatively large profile and has an efficiency less than that desired.

Thus, there is a need for an improved radial flow heat exchanger which is relatively easy to manufacture, of a relatively small profile and which operates efficiently.

An object of this invention is to provide an improved radial flow heat exchanger in which fluid flows from a manifold which includes a plurality of radially spaced flow tubes, connected at their other end to an exit manifold.

Another object of this invention is to provide a radial flow heat exchanger in which a cooling or heating fin structure is positioned in heat conducting contact with radially arranged tubes which pass through apertures in the fin structure.

Yet another object of this invention is the provision of an improved, relatively simple radial heat exchanger which is compact in profile and which is relatively easy to manufacture and assemble.

BRIEF SUMMARY OF THE INVENTION

These and other objects are achieved in accordance with this invention by a unique design of a heat exchanger that is preferably round in shape (or other shape) and which radially directs the fluid to be heated or cooled between the outer perimeter of the heat exchanger and the center of the circle (hub) through several radially disposed tubes (spokes) which interconnect the hub to the perimeter ring. As the fluid travels towards or away from the center, heat is exchanged via a wound spiral ribbon of heat exchange material (fins), such as aluminum sheet metal, through which the tubes pass.

When the fluid gets to the exit of the exchanger it is collected and directed back to the component from which heat is being extracted (or to which it is being added).

In a preferred form, the fluid to be cooled or heated enters into the hollow outer ring through a fluid inlet. The fluid then flows around the perimeter of the hollow outer ring and through all the hollow fluid carrying "spokes". As the fluid passes through the spokes it gives off or picks up heat conducted through the fins. One could use a fan to force air through the fins, or one could use the heat exchanger without a fan at all. Even without forced convection, the radial heat exchanger concept has inherent benefits over a traditional, folded-fin heat exchanger. It is understood however, that the fluid flow may be from the hub to the outer ring, again in a radial direction. Following are some of the benefits over a conventional heat exchanger.

(1) Packaging—If forced convection is used (a fan), and if the fan is approximately the same diameter as the radial heat exchanger, the need for a transition duct to direct the air flow evenly over all the fins is not necessary, as it would be if using a fan to cool a rectangular shaped exchanger efficiently. This elimination of the transition duct reduces the package thickness. Although some rectangular heat exchangers are cooled by fans without using a transition duct, the result is an inefficient use of material.

(2) Ability to be Optimized—When the fluid enters the outer ring (a preferred form) it has the most heat (or ability to absorb heat) at this point. Using the equation for convective heat transfer, as set forth below, it can be shown that the heat transfer can be optimized with a radial design.

$Q=h*A*(T_1-T_2)$ where:

Q is the convective heat transfer, h is the convective heat transfer coefficient, A is the surface area of the fins, $T_1$ is the temperature of the air flowing over the fins, and $T_2$ is the temperature of the surface of the fins The various realities of the equation above include:

(a) The greater the fin surface area, A, the greater the convective heat transfer, Q.

(b) The greater the convective heat transfer coefficient, h, the greater the convective heat transfer, Q.

In other words, heat transfer will increase as the fin surface area and the heat transfer coefficient increase. Applying these considerations to a round radial flow heat exchanger, the device of the present invention provides greater fin surface area near the outer perimeter of the exchanger. This is important since the fluid enters on the outer perimeter and this is when the fluid has the most heat (or ability to absorb heat), as it has just arrived from the component that is being cooled (or heated). In short, there is greater surface area where there is greater heat to be exchanged.

The convective heat transfer coefficient h is a function of several variables. Some of these variables are (1) air temperature, (2) air humidity, (3) velocity of air flow over the fins, (4) volume of air over the fins, and (5) whether the air flow is laminar or turbulent around the fins. From a design standpoint, the three easiest variables to affect to increase heat exchange are (3), (4) and (5). Point number (5) will be touched on later, but for now (3) and (4) will be addressed.

If one is using forced convection to cool the exchanger, the velocity profile of the air out of a standard tube-axial fan is good for optimizing heat transfer with a round radial flow heat exchanger. Note that the highest velocity and volume of air is at the outer perimeter of the fan and decreases towards the center of the fan. This is important because this correlates also to the fin surface area profile of the heat exchanger. Stated another way, the highest air velocity and volume of air from a particular fan (biggest h) is being blown over the area of the heat exchanger with the highest fin surface area (biggest A), at the time that the fluid in the spokes has the most heat (Q) to exchange. This results in very efficient heat transfer.

As the fluid moves radially inward it loses more and more heat (ability to absorb heat decreases). At the same time, the fins on a radial flow heat exchanger get shorter and the airflow from the fan becomes less. To efficiently remove heat from the fluid as it moves radially towards the hub, less and less fin area and air flow are needed. Since these are inherent physical characteristics of a round radial flow heat exchanger and fan combination, heat transfer is optimized. In other words, it is more efficient from a materials usage perspective to have fins that get shorter and shorter. This optimized heat transfer implies another advantage.

(3) Lower Cost—There are several details of this invention that will result in a lower cost heat exchanger when compared to a traditional rectangular machine-folded-fin heat exchanger.

(a) Efficient use of material—As explained above, the efficient utilization of heat exchange material implies the need to use less of it. This leads to a lower raw material cost.

(b) No machine-folded-fins—As will be described in more detail later, this heat exchanger concept does not require the use of machine-folded-fins. The machines needed to make folded-fins are typically very expensive and produce fin stock at a slow rate. High capital investment and a slow production rate drive the final product cost up.

(c) Assembly process—The rate at which these exchangers can be assembled is fast. Additionally, the machines needed to produce final parts should be inexpensive. In large quantity production situations, if something can be produced faster, it is usually cheaper.

The radial flow heat exchanger of this invention may be used as coolant radiators in motor vehicles such as motorcycles, cars, trucks or other forms of transportation or as an oil cooler, either as original equipment or after-market installation. Other uses involve use as a heat exchanger in electronic devices (microchip cooling and the like), HVAC systems, air pre-filters, gas coolers, heat recovery systems, gas/gas re-heaters, and the like.

This invention has many other advantages, and other objectives, which may be more clearly apparent from consideration of the various forms in which it may be embodied. Certain versions of such forms are shown in the drawings accompanying and forming a part of the present specification. These forms will now be described in detail for the purpose of illustrating the general principles of the invention; but it is understood that such detailed description is not to be taken in a limiting sense.

BRIEF DESCRIPTION OF THE DRAWINGS

FIG. 1 is a diagrammatic plan view of a preferred form of the radial flow heat exchanger in accordance with this invention, FIG. 1*a* illustrates a form of the invention in which the radial flow is radially outwardly, FIG. 2 is a view similar to FIG. 1, but illustrating rectangular heat exchanger in accordance with this a invention with a fan, FIG. 3 is a plot showing the general shape of the velocity profile of the air out of a standard tube-axial fan used with the radial flow heat exchanger of this invention, FIG. 4 is a plot of the fin surface area versus radial location, FIG. 5*a* is a fragmentary plan view of a portion of the radial tube and fin arrangement in accordance with this invention, FIG. 5*b* is a side view of the radial tube and fin arrangement shown in FIG. 5*a,*

FIG. 9 is a plan view illustrating a form of this invention in which the fin have varying flow length, FIG. 9*a* is a view taken along the line 9*a*—9*a* of FIG. 9, FIGS. 10 and 10*a* are respectively, a plan view and a sectional of a louver type fin in accordance with this invention, FIGS. 11 and 11*a* are respectively, a plan view and a sectional of a projecting finger type fin in accordance with this invention, FIGS. 12 and 12*a* are respectively, a plan view and a sectional of a stamped type fin in accordance with this invention, FIGS. 13 and 13*a* are respectively, a plan view and a sectional of a lanced offset type fin in accordance with this invention, FIG. 14*a* is a side view of a pre-drawn fin material in accordance with this invention, FIG. 14*b* is an isometric view of the fin material of FIG. 14*a,*

FIG. 14*c* is a fragmentary plan view illustrating the mounting of the fin Material of FIGS. 14*a* and *b* in a radial heat exchanger in accordance with this invention, FIG. 15*a* is a sectional view of a round tube in accordance with this invention, FIG. 15*b* is a sectional view of an elongated tube in accordance with this invention, FIG. 16 is a fragmentary plan view of a fin material or receiving elongated tube or spokes, FIG. 17*a* is a fragmentary plan view of a fin material for receiving a tube or spokes of serrated outer configuration, FIG. 17*b* is a diagrammatic view of a turbulator which may be used inside the tubes to increase heat transfer, FIG. 18 is a plan view of a rounded tube having a smaller diameter at one end, FIG. 19 is a plan view of an elongated tapered tube in accordance with this invention.

DETAILED DESCRIPTION OF THE INVENTION

Figure 6A:
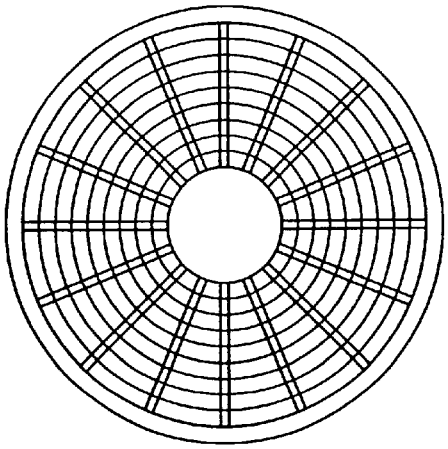
FIG. 6*a* is a plan view showing the use of concentrically arranged strips.

Referring to the drawings which illustrate a preferred form of the invention, FIG. 1 shows a radial flow heat exchanger 10 and which includes an outer fluid tight hollow ring 12 and a fluid tight central hub 15 disposed radially inwardly of the ring 12. For explanation purposes, a heat exchanger in which the flow is radially inward will be described, although it is understood that the flow could be radially outward as illustrated in FIG. 1*a*, the arrows indicating the direction of flow.

The ring 12, illustrated as generally circular, includes a fluid inlet fitting 16, sealed thereto, for introducing fluid into the hollow ring, the latter effectively forming a manifold. The inlet fitting may be brazed or welded to the ring. The ring itself may be circular in cross-section or polygonal, e.g., square, rectangular and the like, and composed of a thermally conductive material, preferably a metal. If desired, depending on the nature of the fluid, the ring and the other components of the exchanger may be of corrosion resistant thermally conductive material. An alternate material is a thermally stable plastic which lends itself to injection molding of the part. The ring thus includes an outer peripheral wall portion 12*a* and an interior wall portion 12*b*. The one end of the tubes are affixed to the interior wall portion 12*b* of the ring, as shown. When used for coolant fluid in an automotive environment, a thermostat may be positioned in or upstream of the inlet fitting, as is well known. The central hub 15, also of a thermally conductive material or a corrosion resistant material, or the other materials described, again generally circular in cross-section to receive the other ends of the tubes, includes an outlet fitting 17, again sealed thereto as described, through which fluid exits (or enters) the exchanger 10.

Attached in a fluid tight manner to the inner peripheral surface of the outer ring are a plurality of individual hollow fluid conducting tubes 20, arranged radially, much like spokes in a wheel, and symmetrically disposed, i.e., uniformly spaced from the adjacent tube along its length, although the spacing progressively decreases from the manifold to the hub. It is understood that the tubes need not be uniformly spaced, although that is the preferred arrangement. Each of the tubes 20 is composed of a thermally conductive material, preferably metal, and includes a first end which is sealed to the ring 12, as shown, and a second end remote from the ring which are sealed to the central hub 15. In a preferred form, the array of tubes 20 all basically lie in the same plane, although it is possible to displace or offset each slightly from the adjacent tube, as will be described. It is also possible to have more than one row of tubes. Further, the tubes 20 are preferably evenly spaced circumferentially around and within the ring, with the spacing between the ends of the tube adjacent the ring being greater than the spacing of the ends of the tubes at the hub. The tubes are made of a thermally conductive material.

Also located between the ring 12 and the hub is a fin assembly 25 in the form of concentrically or spirally disposed heat transfer fins which are in heat transferring contact with each of the tubes. These fins are made of thermally conductive material, as are the tubes. The fin(s) are provided with apertures, as will be described, through which the tubes pass, the apertures of the various fins or portions thereof being in alignment for passage of the tubes radially inwardly from the outer ring 12 to the hub 15.

In practice, the diameter of the tubes is slightly less that the transverse dimension of the ring, such that the tubes are oriented and lie between the top and bottom wall portions of the ring. Such an arrangement provided for a relatively compact profile.

In operation, fluid to be heated or cooled is introduced through inlet 16, enters and flows around the interior of the hollow ring 12, flows radially inwardly through each of the tubes to the center hub and exits out the outlet 17. As noted, one end of each of the tubes is in sealed fluid communication with the ring 12 and the other end of each tube is in sealed fluid communication with the hub 15. As fluid flows through the tubes or spokes 20, it gives off or picks up heat conducted through the tube wall to and through the fins 25.

One may use a fan or other air moving device to force air through the fin structure for cooling or heating, as may be needed. One of the advantages of the use of a heat exchanger which is generally circular in shape is that it is easy to use a tube-axial fan which effectively covers the entire working surface of the heat exchanger. Where a heat exchanger 10*a* is rectangular in shape, as shown in FIG. 2, the circular fan 26 is incapable of causing air to flow over the corners 27 of the heat exchanger without spacing the fan from the heat exchanger.

Referring to FIG. 3, if one is using forced convection to heat or cool a heat exchanger, the velocity profile of the air out of a standard tubeaxial fan is good for optimizing heat transfer with a round radial flow heat exchanger. Note that the highest velocity and volume of air are at the outer perimeter of the fan, Rmax and Vrmax and decrease towards the center of the fan, $R_0$. In the radial design with the fin structure of this invention, it is also apparent that the highest velocity and volume of air flow from a particular fan (biggest h) is being blown over the area of the heat exchanger with the highest fin surface area (biggest A) at the time that the fluid in the spokes has the most heat (Q), in the case of flow radially inwardly of heated fluid in the heat exchanger. As seen in FIG. 4, the maximum surface area of the fins ARmax, is at the maximum radius, Rmax.

As fluid moves radially inwardly, it loses more and more heat (ability to absorb heat decreases). At the same time, the fins in the radial flow arrangement of this invention, get shorter and shorter in circumferential dimension, the air flow from the fan becomes less. To efficiently remove heat from the fluid as it moves radially towards the hub, less and less fin area and air flow are needed. Since these are important characteristics of the round radial flow heat exchanger of this invention when used with forced air, heat transfer is optimized. This is illustrated in FIGS. 5*a* and 5*b*.

In FIG. 5*a*, for purposes of explanation, the fluid flow is radially inwardly from the ring 12, through the tube to the hub 15. The circumferential dimension of the fins gradually decreases from a maximum at the ring to a minimum at the hub. FIG. 5*b* illustrates another feature of this invention, i.e., a progressive decrease in fin height from a maximum at the ring to a minimum at the hub. FIGS. 5*a* and 5*b* also illustrate the spaces between adjacent fins. This optimized heat transfer also provides other advantage.

Figure 6B:
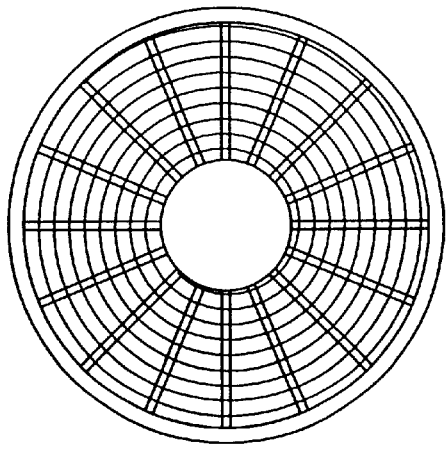
FIG. 6*b* is a view similar to FIG. 6*a* but illustrating strips as a continuous wound spiral.

(1) The fins could be made of multiple spaced circular concentric strips of heat conductive material, as seen in FIG. 6*a* or one continuous spiral, again with spaces between adjacent coils, as shown in FIG. 6*b*. In a preferred form the strips are generally thinner in cross-sectional thickness than they are wide.

Figure 7:
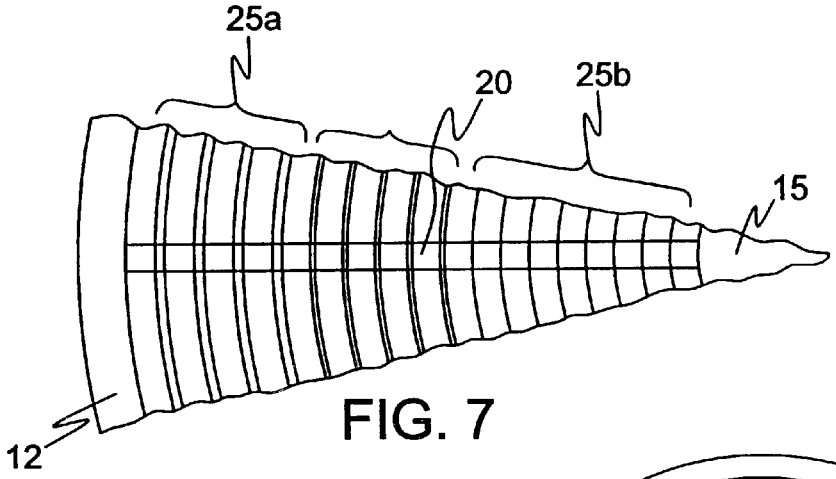
FIG. 7 is a fragmentary plan view showing the use of thicker and thinner fins in accordance with this invention.

(2) In any individual heat exchanger, the fins may be made from several different thicknesses of heat exchange material to further optimize use of material for efficient heat exchange. For example, as shown in FIG. 7, the fins 25*a* on the outer periphery near the ring 12 may be thicker to help carry more heat out further, while closer to the center, e.g. at 25*b*, where the fins are shorter and do not need to carry the heat as far, they could be made of a thinner material.

Figure 8:
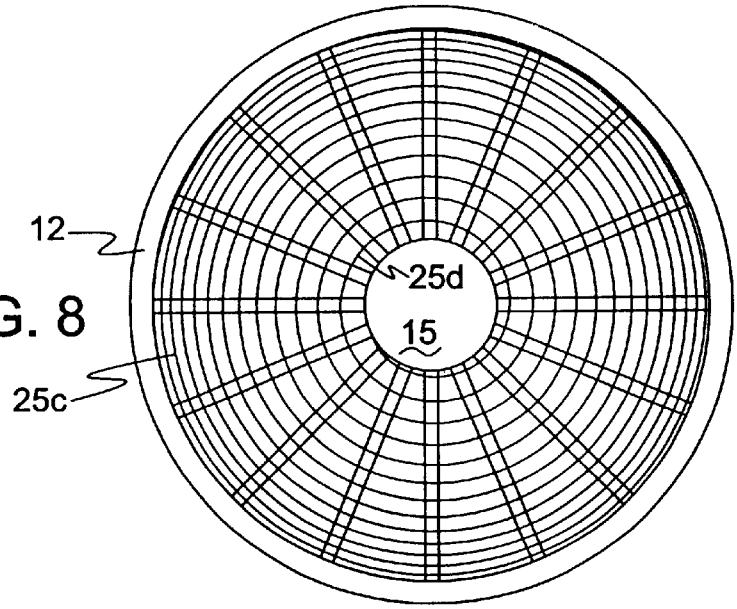
FIG. 8 is a plan view illustrating a form of this invention in which the fin spacing is varied as a function of their radial location.

(3) In any individual heat exchanger the spiral or coils can be wrapped so that the spacing between fins varies depending on the radial location. Once again, this may be done to optimize the use of material for efficient heat exchange. Such an arrangement is shown in FIG. 8 in which the radial spacing between adjacent coils progressively increases from a minimum (25*c*) at the ring 12 to a maximum (25*d*) a t the hub.

(4) In any individual heat exchanger, the fin flow length, the front to back or transverse fin dimension, may vary to optimize the use of materials for efficient heat exchange. As seen in FIGS. 9 and 9*a*, for example, the fins 25*e* on the outer periphery could have a greater flow length to help carry the heat out further, while those 25*f* closer to the center of the exchanger may have a flow length which is reduced as needed. Flow length is measured from the point of attachment to the tubes to either the front or back of the heat exchanger. Flow length is a measurement of the transverse fin dimension.

(5) For a given material thickness, the number of fins per inch (FPI) for a radial heat exchanger can be greater than the number of FPI for machine-folded-fin stock. This results in the ability to increase the heat exchanger surface area for a given volume, thus leading to a smaller package. The spacing of fins in machine-folded-fin stock is limited by structural requirements of the "fingers" that fit between the individual fins during the folding process.

(6) Holes to accommodate the insertion of the spokes through the fin material could either be pre-punched in the raw material stock or punched once the fin stock is positioned in a spiral.

The raw fin material can be pre-stamped with any number of different patterns to improve heat transfer by promoting turbulent flow (and in some cases by also increasing the total fin surface area). Turbulent flow increases the heat transfer coefficient, and thus the total heat transfer. The several forms of fin structure include pre-stamping the fins to include multiple spaced louvers 35 as shown in FIGS. 10 and 10*a*, or that shown in FIGS. 11 and 11*a* in which a plurality of spaced fingers 35*b* that stick up to catch the air. FIGS. 12 and 12*a* illustrate stamped (drawn) pin fins 35*c* extending from the fin body, their cross-section being shown in FIG. 12*a*.

(7) A lanced and offset fin structure as illustrated in FIGS. 13 and 13*a* in which the lanced fins 35*d* are lanced with peaks 35*e* from the body of the fin strip and arranged in an angular orientation along the length of the fin strip. An added benefit of the various fin structures described is that they increases the heat transfer surface area of the fin material.

(8) In addition to the raw material being pre-punched to make holes for the fluid carrying spokes, it may also be pre-drawn to create shoulders, as seen in FIGS. 14*a*, 14*b* and 14*c*. These shoulders 40 whose center has been punched out, could be used to (a) space the layers of fin stock a predetermined distance, (b) create a means by which one layer of fin material could register on the previous layer to pre-align the holes in preparation for the insertion of the spokes and (c) create a larger contact surface area between the spokes and the fins, all as illustrated in FIG. 14*c*.

(9) The raw fin stock could be pre-coated with braze material for the brazing process. This could allow faster production times if brazing is used.

In the case of the radial tubes used in accordance with this invention, they need not necessarily be round or circular in cross-section, for example as shown in FIG. 15*a*. For example, in oil cooler fluid carrying tubes, it is preferred to have radial tubes that are long and thin, i.e., have a flattened configuration as shown at 20*a* in FIG. 15*b*. The benefit of long, flat and elongated radial tubes is that such a shape provides a larger amount of exterior surface amount of exterior heat transfer surface area for a give amount of fluid cross sectional flow area. In other words, the ratio of the tube perimeter to the tube flow area P(elongated)/A(elongated) is greater in a flattened shape than it is in a round tube, P(round)/A(round). This provides better heat transfer between the fluid and the tube. The spokes or radially arranged tubes themselves can be utilized to help promote turbulent flow. This may take various forms of which three different forms, are illustrated in FIGS. 16 and 17. First, as shown in FIG. 16, the orientation of the spokes themselves, could be used to divert the air. Here, the spokes or tubes are received in spoke or tube holes 20*d* which are angularly oriented so that the flow is as indicated by the arrows. In a second form illustrated in FIG. 17, the cross sectional shape of the spokes could be made to chop up the flow, as by apertures 20*e* which are serrated at the outer surface so as to form an external turbulator which directs the flow as indicated by the arrows. The external surface of the tubes may be textured by roughening by a process such as sand blasting. FIG. 17*b* shows a turbulater 21 which is in the form of a spiraled strip inserted into the interior of the tube or spoke and in heat transfer contact with the interior tube wall. Such a structure not only transfers heat but creates turbulent flow for more efficient heat transfer.

The spokes or tube cross-section may vary along its length, i.e., may taper from the outer perimeter of the heat exchanger to the central hub. This structure is illustrated in FIG. 18 in which one end 40 of the tube is of a diameter larger than the diameter at the other end 41 so as to provide a tapered overall configuration. Such a configuration would slow the speed of the fluid near the outer perimeter of the heat exchanger, where most of the heat transfer takes place, and allow more time for the heat transfer process to happen. Where there is flow radially outward, the arrangement may be reversed.

FIG. 19 shows an elongated tube 20*f* having a larger open cross-section at end 42 as compared to end 43. Again, the effect is to slow flow near the perimeter and speed up the flow at the hub.

Figure 20:
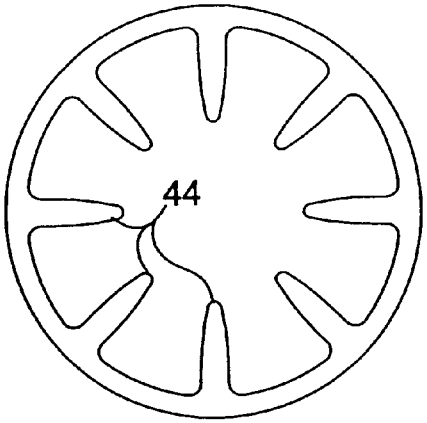
FIG. 20 is a sectional view of a modified form of heat exchanger tube with internal ribs.

Heat transfer may be improved by fabricating the spokes or tubes with internal ribs 44, as shown in FIG. 20 to increase the contact area between the fluid and the spokes.

In the various tube configurations described the raw spoke tube material may be pre-coated with braze material for the brazing process. This may allow faster production times if brazing is used.

It is of course understood that the number and spacing of spokes can be varied for heat exchanger optimization.

Figure 21:
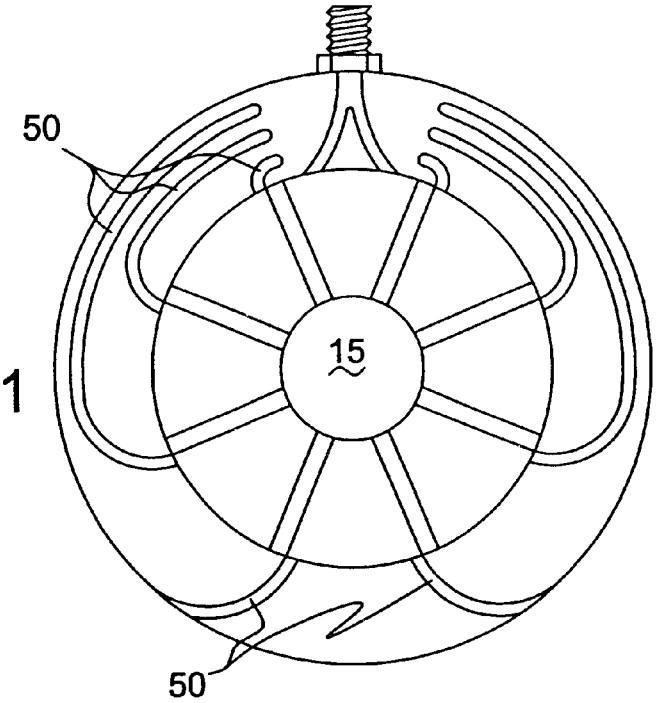
FIG. 21 is a diagrammatic view illustrating flow direction vanes which may be used in the outer ring section.

The amount of fluid flow through each spoke is partially dependent on the location of the fluid inlet around the perimeter of the outer ring. The effects of gravity will influence the flow rate through each spoke also. It is important to equalize the flow through each spoke, and thus equalize heat transfer over the entire surface area of the exchanger. Thus, as shown in FIG. 21 directional vanes 50 are located within the outer ring so that as the fluid enters the outer ring it is forced to reach all spokes evenly.

Figure 22:
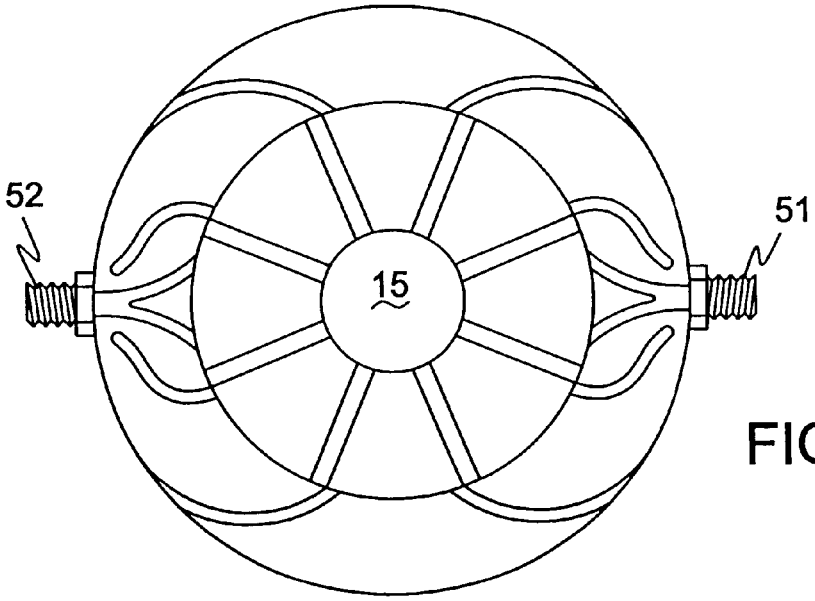
FIG. 22 is a view similar to FIG. 21 but illustrating a multiple inlet heat exchanger in accordance with this invention.

In another form, again to help equalize flow through all the spokes, is to have more than one fluid inlet into the outer ring, as illustrated in FIG. 22 at 51 and 52. This structure may also be used in conjunction with the directional vanes, already described.

Figure 23:
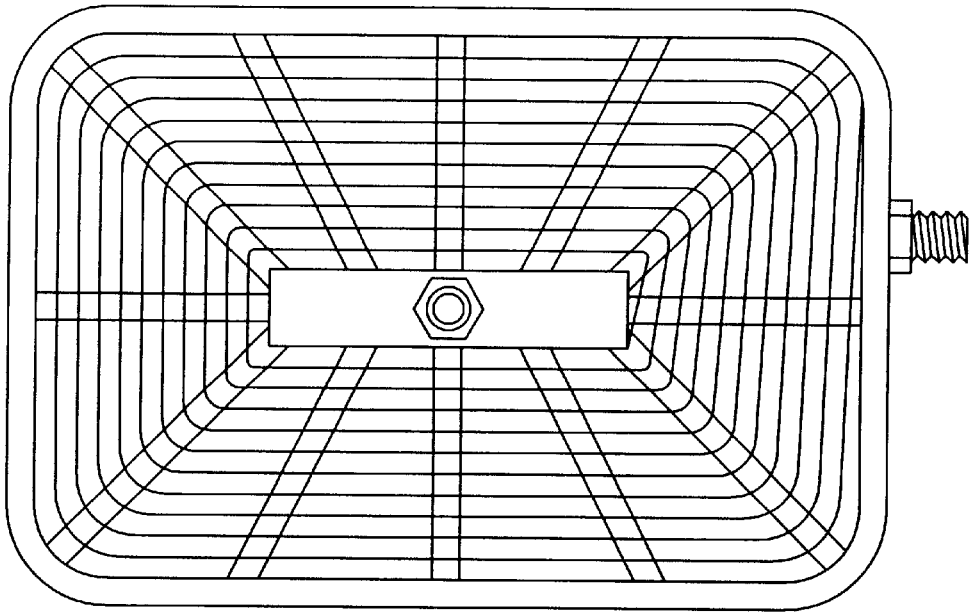
FIG. 23 is a diagrammatic plan view of a heat exchanger in accordance with this invention in a rectangular configuration with a single fin spiral.
Figure 24:
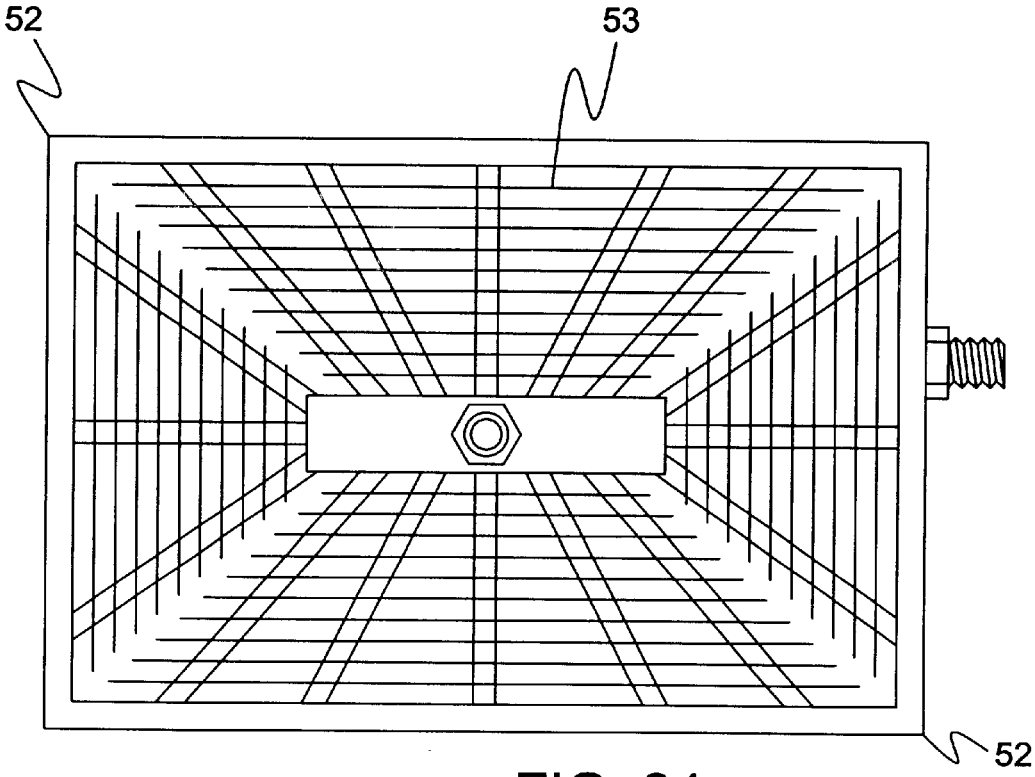
FIG. 24 is a diagrammatic plan view of a heat exchanger in accordance with this invention in a rectangular configuration with separate fin pieces.

The radial flow arrangement of this invention is not limited to a round shape. The overall configuration may just as well be square, or rectangular, or triangular, or oval, or any number of other shapes. FIGS. 23 and 24 show some of the shapes which may be used. Additionally, any shape that has distinct corners 53, as shown in FIG. 24 that makes the spiraling of fin material more difficult may be fabricated using separate fin pieces 52. It is also possible and desirable to space the spokes on a non-circular radial heat exchanger in a non-equal manner to optimize the fin area in contact with each spoke, also shown in FIG. 24.

The radial fluid flow structure of this invention may be used in a situation where one needs a constant temperature distribution over a given area. In other words, by varying some of the structural features such as (a) fin material thickness, (b) fin spacing, (c) fin flow length and (d) stamped fin patterns, one may make a radial heat exchanger so that the temperature of air flowing through all areas of the exchanger could be kept nearly at a constant value.

Figure 25A:
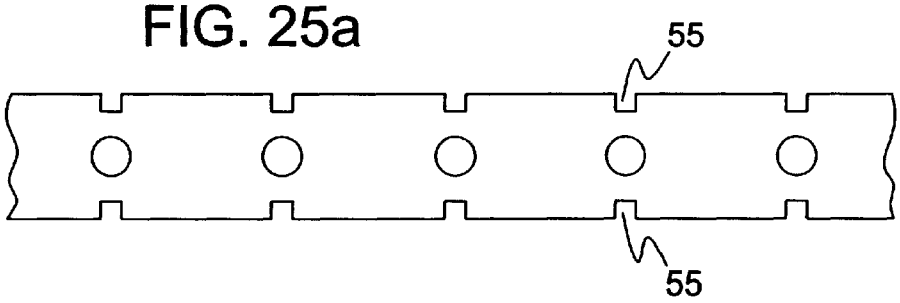
FIG. 25*a* is a plan view of fin material showing the side notches for assembly.

In order to ensure good alignment between holes in subsequent layers of the fin material, one may stamp or punch some type of alignment feature simultaneously with the creation of the holes in the fin material. This is illustrated in FIG. 25*a* in which notches 55 are provided along the length of the fin strip. The notches are then used to register with mating details on the assembly fixture and guarantee easy insertion of the spokes.

Figure 25B:
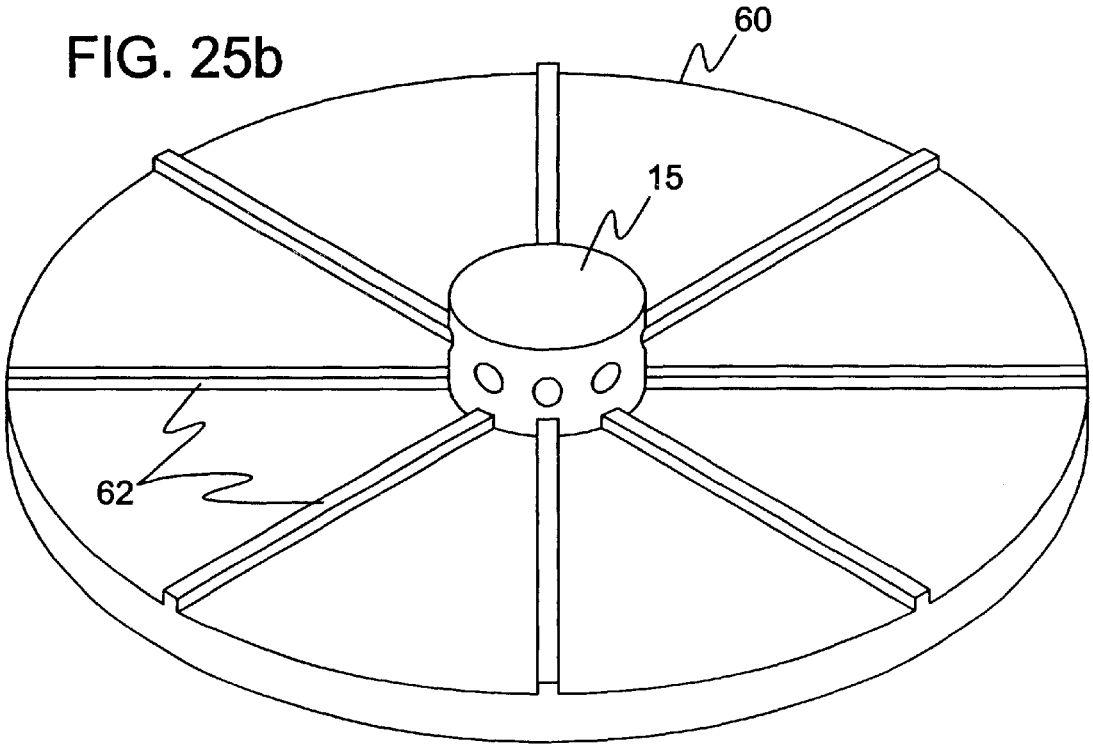
FIG. 25*b* is an isometric and diagrammatic view of an assembly fixtures for building the heater exchange of this invention.

One form of assembly or jig is illustrated in FIG. 25*b*. The assembly jig/fixture 60 is made to hold the central hub 15, the outer ring (not shown) and to locate the fin material. Thus, ribs 62 are arranged with respect to the hub and the desired spacing The hub 15 is placed in the center of the fixture and the fins are placed concentrically around it, or spiraled around it with the notches 55 of the fin strip being received on the ribs 62. With the central hub and fins in place and their tube holes lined up, the inner portion of the outer ring is placed around the assembly so that its holes line up with those of the fins and central hub. The spokes or tubes are then inserted into the holes until one end of each spoke is seated within the central hub and the other end within the inner portion of the outer ring. Optionally, a bar can be pushed through the inside of each spoke to expand them to cause intimate contact with the fin material. Now the remaining portion of the outer ring can be installed. Instead of, or in conjunction with the expansion, the entire assembly can be brazed.

Figure 26:
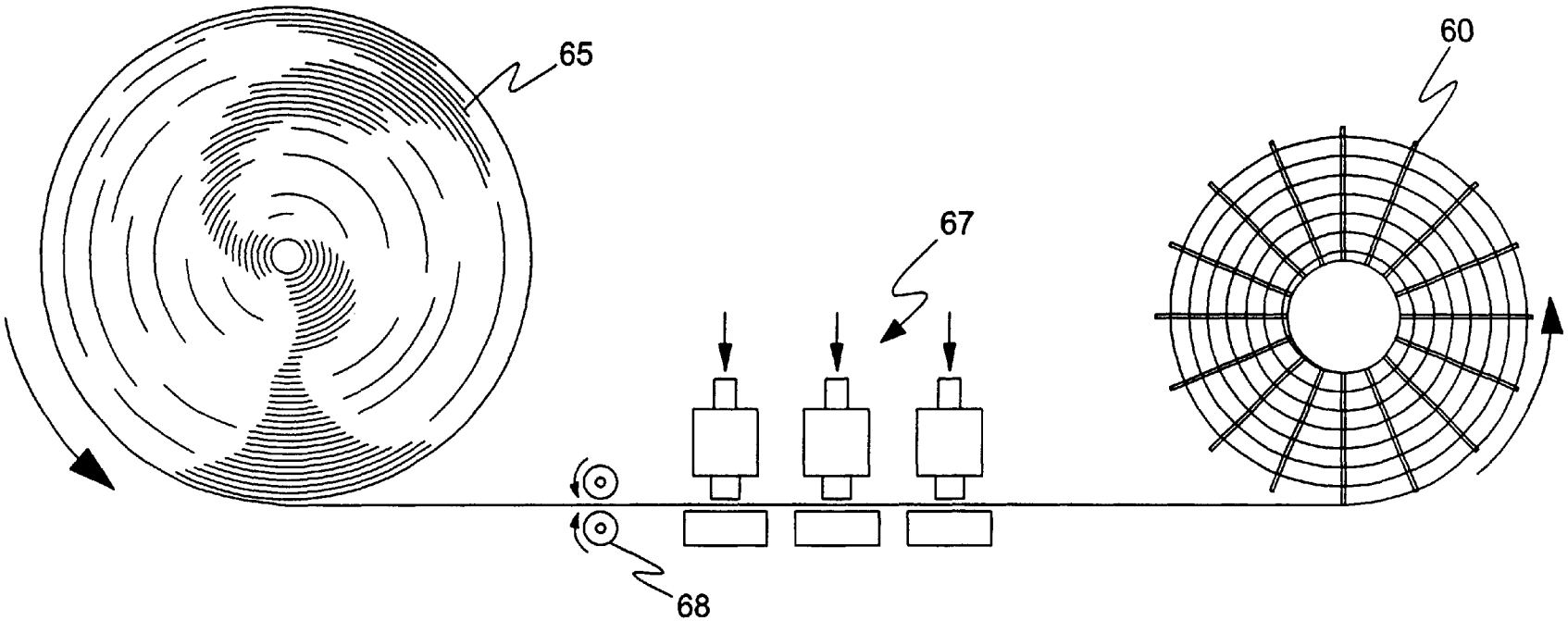
FIG. 26 is a drawing illustrating the production of fin material and assembly of the same.

In production one fabrication method which is both extremely fast and which requires relatively little capital investment for the machines and tooling is shown in FIG. 26. The raw fin material 65 is placed on as pool that can rotate. The raw fin material on the spool is threaded through a series of computer-controlled stamping machines 67 and is pulled (or pushed) through said machines by a computer-controlled servo motor 68. After going through the machines and being stamped, the fin material is wound onto a rotating assembly fixture 60, or in the case of fin material with pre-drawn shoulders wound on itself, the previous layer providing a place for subsequent layers to register. Final assembly and brazing (if desired) could be accomplished as already described. As mentioned, the servo motor and stamping machines are controlled by computer. The locations for all the spoke holes and any other stamping procedure for a given heat exchanger structure may be easily described and controlled by any type of spreadsheet program. The described process is a relatively straight forward and simple method for building a heat exchanger. This type of production process is quite fast and inexpensive, especially when compared to the methods that are used for conventional machine-folded-fin heat exchangers.

Figure 27:
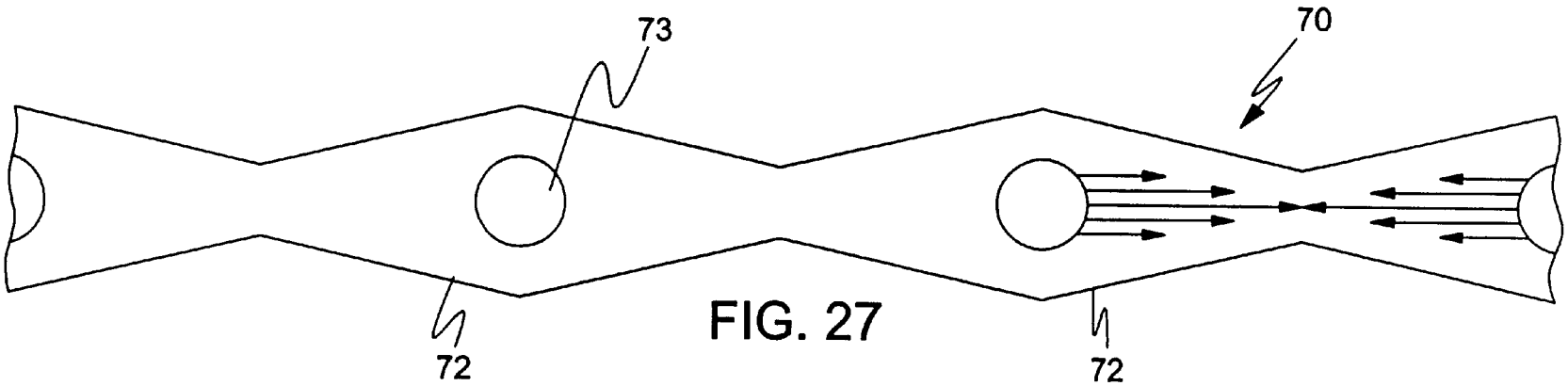
FIG. 27 is a view illustrating yet another form of fin material in accordance with this invention.

The fin strip may also be fabricated to promote heat transfer. Referring to FIG. 27, a fin strip 70 is formed with a series of triangularly shaped fins 72 in which the tube aperture 73 is located. Thus, the portion between holes has the narrowest transverse dimension, as shown. The heat flow is as indicated by the arrows. As the heat travels away from the tubes, more and more heat is removed. Further, this arrangement lightens the weight of the heat exchanger and reduces the cost for the fin material.

Figure 28:
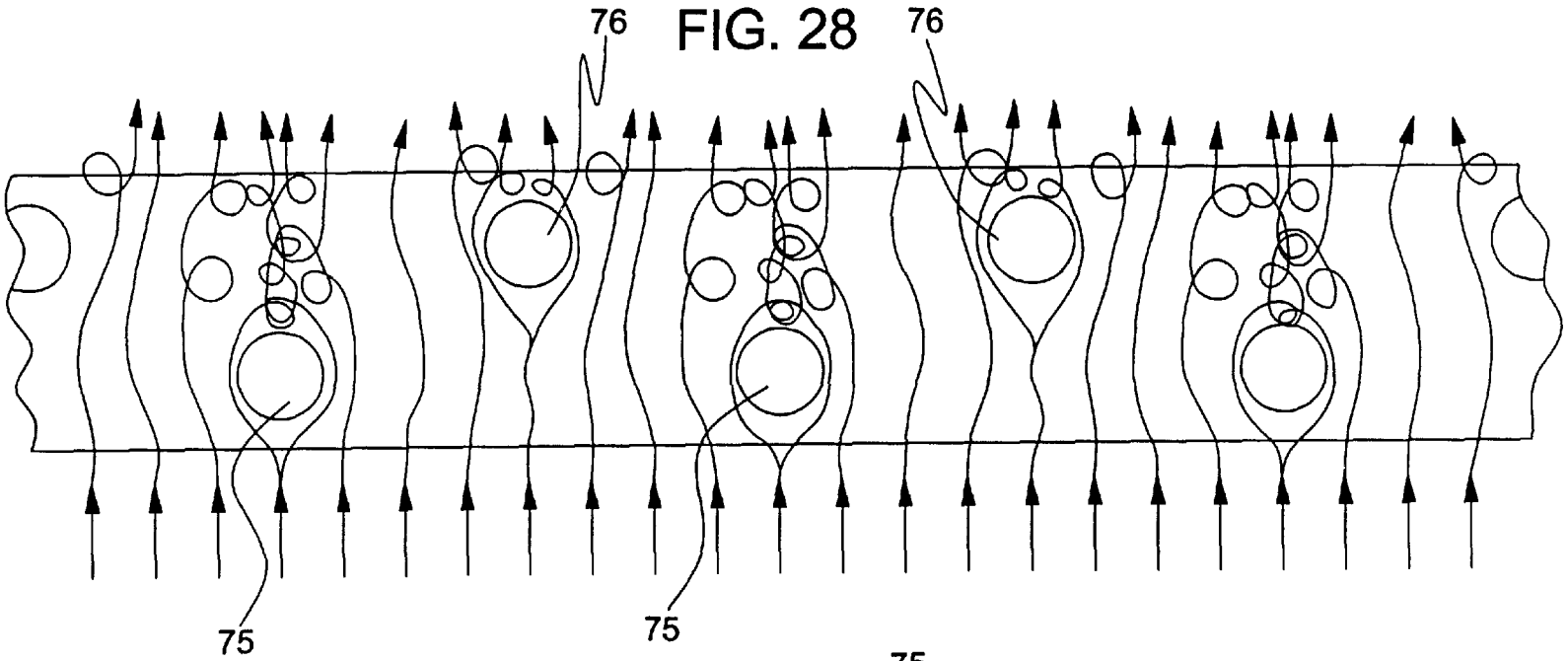
FIG. 28 illustrates the flow of air as it relates to the arrangement of the spokes or tubes.
Figure 28B:
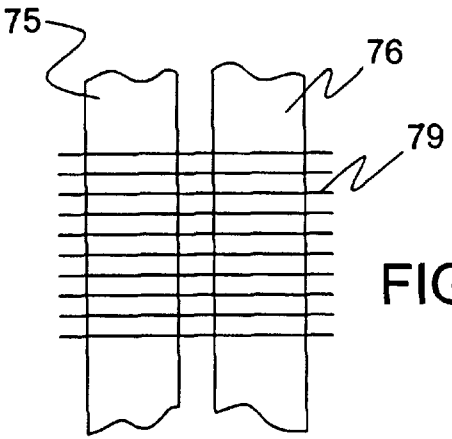
FIG. 28*b* is a diagrammatic view of a fin with two rows of spokes or fluid passages.
Figure 28A:
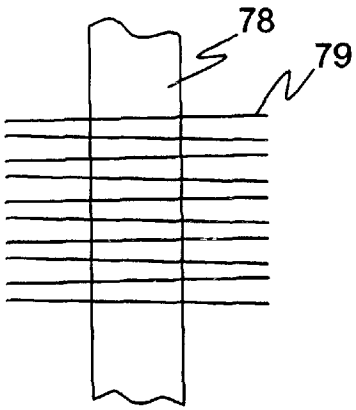
FIG. 28*a* is a diagrammatic view of a fin with one row of spokes or fluid passages.

Referring to FIGS. 28, 28*a* and 28*b*, a structure is shown in which more than one row 75 of tubes or spokes is used by including a second row of spokes 76 which are off-set from the first. As shown in comparing FIGS. 28*a* and 28*b*, one row of tubes 78 may not insure parallelism of the fins 79. With two rows of fins 75 and 76, as shown in FIG. 28*b*, the fins 79 are held in parallel relation. The use of two rows of tubes as described, also has the advantage of allowing added fluid flow, increases the heat transfer surface area, promotes turbulent air flow as shown by the arrows in FIG. 28 and assures parallelism of the fins.

Figure 29B:
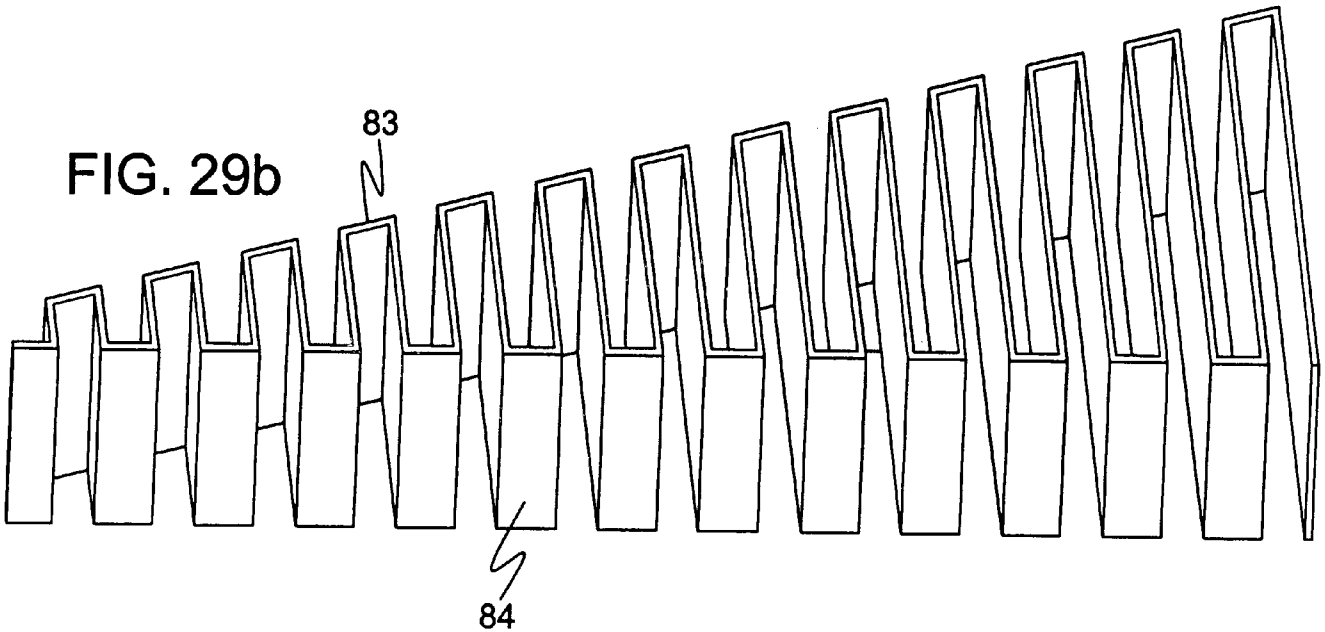
FIG. 29*b* is an isometric view of a machine folded fin element itself.
Figure 29A:
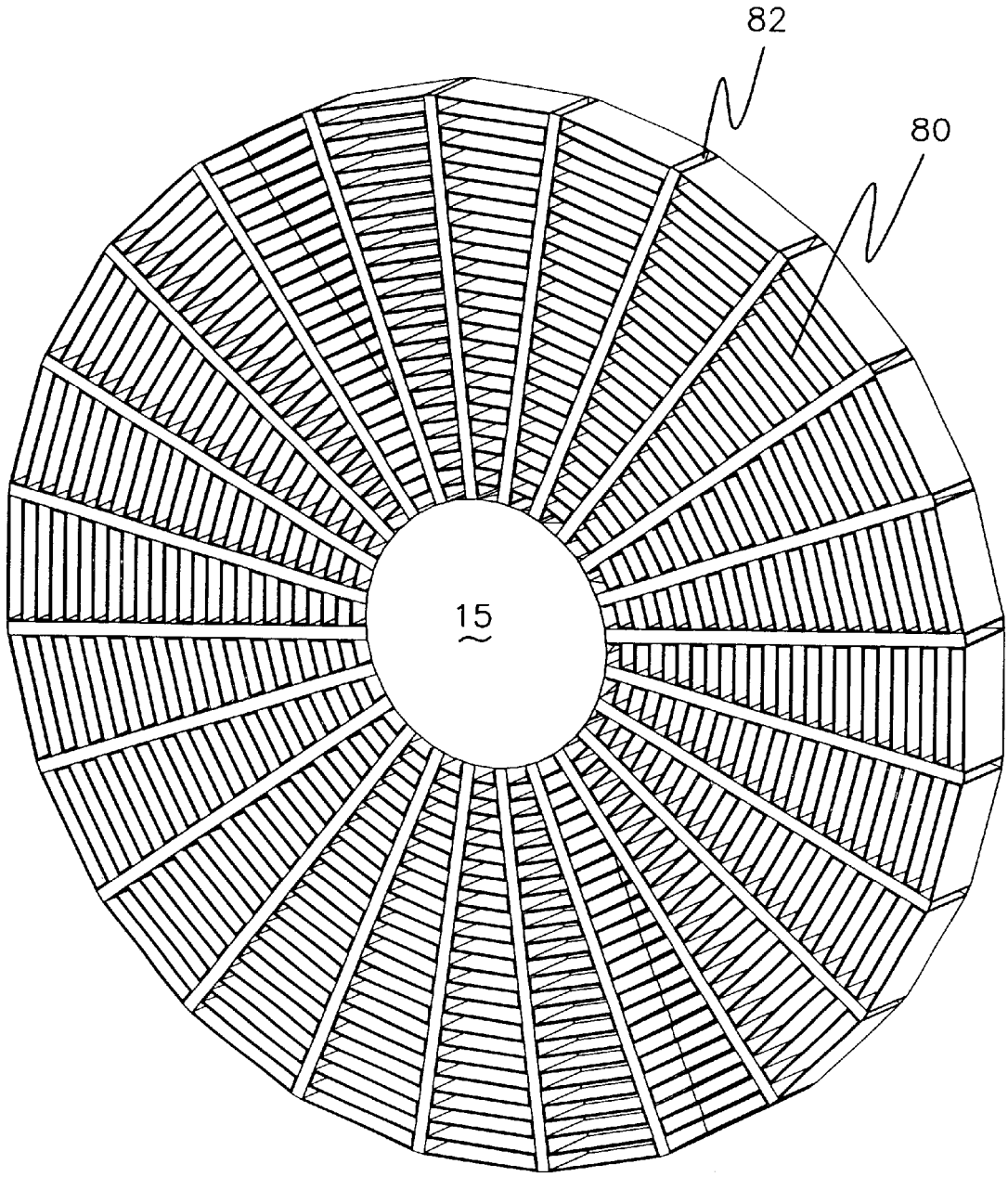
FIG. 29*a* is an isometric view of a machine folded fin wedge structure assembled in the heat exchanger.

FIGS. 29*a* and 29*b* illustrate yet another form of fin arrangement in which the fins 80 are folded fin stock. In this form, the tubes or spokes 82 are rectangular in shape, in heat contact with the side walls 83 and 84 of the fins, see FIG. 29*b*, and connected at one end to the hub and at the outer peripheral end to the ring (not shown). In this form, the fins are not continuous or spiraled strips, but wedge sections located between adjacent rectangular tubes. The fin wedges may be brazed in placed or held in compression between adjacent rectangular tubes.

It should be understood that this invention is not limited to the detailed descriptions set forth herein which describe in detail preferred forms of the present invention. Modifications thereof will be apparent to those skilled in the art, based on the above detailed disclosure, but such modifications based on this disclosure may not be deemed to depart from the spirit and scope of the present invention as set forth in the appended claims.

What is claimed is:

1. A radial heat exchanger for heating or cooling a fluid, comprising:

a sealed fluid manifold for receiving and for passage of fluid from an outside source into or out of said heat exchanger and having an interior peripheral portion, a sealed fluid receiving hub spaced interiorly and radially with respect to said interior peripheral portion of said manifold and including a passageway for passage of fluid from or to an outside source into or out of said heat exchanger, a plurality of separate and spaced fluid flow tubes, each having an inner and outer wall and a first end and second end, the first end of each tube being in sealed fluid communication with said manifold, the second end of each tube being in sealed fluid communication with said hub, said fluid to be heated or cooled flowing through said tubes in one direction between said fluid manifold and said hub, said fluid to be heated or cooled either flowing into said manifold from an outside source and then into and through said tubes to said hub or said manifold receiving flow of fluid from said tubes for discharge of the same out of said heat exchanger, a fin assembly positioned between said manifold and said hub, said fin assembly including a heat conducting material arranged at spaced intervals between said manifold and said hub, said heat conducting material arranged in a spiral and including a plurality of spaced apertures therein for passage therethrough of said tubes, said fin assembly having a progressively increasing surface area between said manifold and said hub whereby the maximum surface area of said fin assembly in the region of said manifold and the minimum surface area is in the region of said hub, said heat conducting material being disposed in a generally annular orientation between said hub and said manifold, and said heat conducting material being in intimate heat conducting contact with the outside wall of each said tube whereby fluid flowing between said manifold and said hub flows into each of said tubes in a radial direction between the manifold and said hub and wherein said heat conducting material of said fin assembly operates to give up or pick up heat from said fluid through the wall of said tubes.

2. A radial flow heat exchanger as set forth in claim 1 wherein said manifold is generally circular in overall external shape.

3. A radial flow heat exchanger as set forth in claim 1 wherein said manifold is generally rectangular in cross-section.

4. A radial flow heat exchanger as set forth in claim 1 wherein the fins which make up the fin assembly have a front to back dimension which is greater at one portion of the heat exchanger than at another portion thereof.

5. A radial flow heat exchanger as set forth in claim 1 wherein said tubes are flattened tubes.

6. A radial flow heat exchanger as set forth in claim 1 wherein said manifold includes a front and rear face, and said tubes are displaced from each other and wherein all are located between said front and rear face.

7. A radial flow heat exchanger as set forth in claim 1 wherein said fin assembly includes means to turbulate any fluid flowing therethrough.

8. A radial flow heat exchanger as set forth m claim 1 wherein said fin assembly includes a fin strip having a series of spaced shoulders disposed along the length to register one layer of a fin strip with an adjacent layer of the fin strip.

9. A radial flow heat exchanger as set forth in claim 1 wherein said exchanger includes a plurality of rows of fluid flow tubes each attached at one end to said manifold and at the other end to said hub.

10. A radial flow heat exchanger as set forth in claim 1 wherein said tubes have a larger internal diameter at one end as compared to the internal diameter at the other end.

11. A radial flow heat exchanger as set forth in claim 1 wherein said manifold includes interior directional vanes for controlling the direction of the fluid therein.

12. A radial flow heat exchanger as set forth in claim 1 wherein said tubes include means on the interior thereof for turbulating the flow of the fluid therein.

13. A radial flow heat exchanger as set forth in claim 1 wherein said fin assembly includes a fin strip having a plurality of spaced apertures therein and wherein the width dimension of said strip is less between said apertures than in the region of said apertures.

14. A radial flow heat exchanger as set forth in claim 1 wherein said fin assembly includes a fin strip having a plurality of spaced apertures therein and wherein said fin strip further includes means therein for turbulating the flow of fluid between adjacent tubes.

15. A radial heat exchanger for heating or cooling a fluid, comprising:

a sealed fluid manifold for receiving and for passage of fluid from an outside source into or out of said heat exchanger and having an interior peripheral portion, a sealed fluid receiving hub spaced interiorly and radially with respect to said interior peripheral portion of said manifold and including a passageway for passage of fluid from or to an outside source into or out of said heat exchanger, a plurality of separate and spaced fluid flow tubes, each having an inner and outer wall and a first end and second end, the first end of each tube being in sealed fluid communication with said manifold, the second end of each tube being in sealed fluid communication with said hub, said fluid to be heated or cooled flowing through said tubes in one direction between said fluid manifold and said hub, said fluid to be heated or cooled either flowing into said manifold from an outside source and then into and through said tubes to said hub or said manifold receiving flow of fluid from said tubes for discharge of the same out of said heat exchanger, a fin assembly positioned between said manifold and said hub, said fin assembly including a heat conducting material arranged at spaced intervals between said manifold and said hub, said fin assembly including fins having a thicker cross-section at one portion of the fin assembly than the fins at the other portion of said fin assembly and wherein each fin contacts a tube to provide a zone of fins of thicker cross-section between said manifold and hub, said fin assembly having a progressively increasing surface area between said manifold and said hub whereby the maximum surface area of said fin assembly in the region of said manifold and the minimum surface area is in the region of said hub, said heat conducting material being disposed in a generally annular orientation between said hub and said manifold, and said heat conducting material being in intimate heat conducting contact with the outside wall of each said tube whereby fluid flowing between said manifold and said hub flows into each of said tubes in a radial direction between the manifold and said hub and wherein said heat conducting material of said fin assembly operates to give up or pick up heat from said fluid through the wall of said tubes.

* * * * *